United States Patent [19]

Johnson

[11] 4,180,233

[45] Dec. 25, 1979

[54] BUILDING CONSTRUCTION SYSTEM

[75] Inventor: James H. Johnson, Rochester, N.Y.

[73] Assignee: Housing Systems, Inc., Penfield, N.Y.

[21] Appl. No.: 952,517

[22] Filed: Oct. 18, 1978

Related U.S. Application Data

[63] Continuation-in-part of Ser. No. 712,961, Aug. 9, 1976, abandoned, and a continuation-in-part of Ser. No. 146,904, May 26, 1971, abandoned, and Ser. No. 809,071, Mar. 21, 1969, abandoned.

[51] Int. Cl.[2] ..... B28B 7/30

[52] U.S. Cl. ..... 249/144; 249/27; 249/39; 249/178; 249/180; 249/184; 249/185; 264/35

[58] Field of Search ..... 264/35; 249/27, 39, 249/152, 178, 180, 182, 184, 185, 63, 144; 425/438

[56] References Cited

U.S. PATENT DOCUMENTS

| | | | |
|---|---|---|---|
| 2,593,465 | 4/1952 | Tourneau | 249/184 |
| 2,633,621 | 4/1953 | Moss | 264/35 |
| 2,717,436 | 9/1955 | Le Tourneau | 249/184 |
| 2,834,089 | 5/1958 | Bast et al. | 249/144 |
| 2,864,150 | 12/1958 | Henderson | 249/184 |
| 3,315,424 | 4/1967 | Smith | 264/35 |
| 3,518,331 | 6/1970 | Marin | 264/35 |
| 3,676,536 | 7/1972 | Shelley | 264/33 |
| 3,680,824 | 8/1972 | Kesting | 249/178 |
| 3,811,646 | 5/1974 | Beasley | 249/184 |
| 4,042,659 | 8/1977 | Botting | 249/144 |
| 4,093,173 | 6/1978 | Kawamata | 249/144 |

*Primary Examiner*—Donald J. Arnold
*Attorney, Agent, or Firm*—Frank A. Steinhilper

[57] ABSTRACT

A building construction system uses a mold set up at a construction site so that the external part of the mold is spaced clear of the internal part. Building elements including those which are functional in the construction operation are arranged around the internal mold part. Such functional elements include connecting rod anchorages around the lower region of the mold, and the like. The external mold part is moved into position near the internal mold part, and the mold is filled to form a casting. A lifting frame is arranged over the mold and adjustably connected to the connecting rods. Then the external mold part is moved away to release the casting, and the frame is lifted to raise the casting up over the mold for movement to a building site near the construction site. To facilitate release of the casting from the internal mold part, the internal mold portion is formed of outward facing walls that are supported so they are braced against inward motion from a lowermost position and are permitted to move inwardly as the walls are raised from the lowermost position. This affords clearance between the internal mold parts and the casting as the casting is lifted. The mold also has corner release means and the system may include release elements affixed to the building during casting.

11 Claims, 19 Drawing Figures

BUILDING CONSTRUCTION SYSTEM

RELATED APPLICATIONS

This application is a continuation-in-part of parent application Ser. No. 712,961 filed Aug. 9, 1976, and in turn continuations in part of applications Ser. No. 146,904, filed May 26, 1971, and application Ser. No. 809,071 filed Mar. 21, 1969, all of which are now abandoned.

THE INVENTIVE IMPROVEMENT

Casting buildings of concrete at a construction site and setting them in place at a nearby building site has many advantages, and ways of accomplishing this have been proposed by LeTourneau in his U.S. Pat. Nos. 2,593,465 and 2,717,436. However, many unresolved problems have made such a method commercially impractical. The invention involves analysis of the problems involved in casting whole building of multiple room or multi-cell size, and lifting, transporting and setting such buildings in place in an efficient, reliable and economically feasible way.

For example, one of the problems is release of the casting from the internal mold part. Internal mold parts which result in interior walls that lean inward as they rise are undesirable for most buildings, and the invention solves this problem with a simple and practical system that includes a vertical, interior wall and automatic release from the internal mold parts.

Another problem is in picking up such a large and heavy casting and moving it about safely without cracking, breaking, or damaging the building. LeTourneau suggested using the external mold part as a support and lifting the casting and the external mold part together. This severely limits the overall size and weight of the casting that can be practically lifted. The invention proposes a system of anchored connecting means built into the casting and adjustably connectable to a strong back or hoisting frame arranged over the casting, so that the casting can be raised clear of both the internal and external mold parts and lifted and transported safely without any external support other than the lifting frame.

The methods, equipment and construction materials of the inventive system are all inter-related to provide a system that has proved practical and efficient in casting whole buildings at a time at a construction site and lifting and setting the buildings in place on nearby building sites. The many features of the inventive system combine and cooperate to provide efficient, rapid, reliable and economical building construction allowing varied and attractive designs.

SUMMARY OF THE INVENTION

The inventive building construction system includes setting up a mold for a building at a construction site so that the external part of the mold is spaced to clear a working area around the internal part of the mold. Elements to be included in the building are arranged around the internal mold part. Such elements may include anchorages for connecting means spaced around the lower region of the internal mold part, and wall release elements such as wallboard as well as reinforcing, plumbing, electrical elements and the like. Then the external mold part is moved into position near the internal mold part, and the mold is filled with a construction material that sets to form a casting. After setting, a hoisting frame is arranged over the mold and adjustably connected to the anchorages. Then the external mold part is moved away from the casting, and the frame is lifted with lifting equipment to release the casting from the internal mold part and lift the otherwise unsupported casting up over the internal mold part so that the casting can be transported and set down on a building site near the construction site.

The inventive system preferably uses a mold having a base supporting an internal portion and an external portion which is connected to be movable relative to the internal portion, and the internal portion has outward facing walls that are supported for relative motion on the base so that they are braced against inward motion from a lowermost position of the walls and allowed to move inward as the walls are raised from the lowermost position.

DRAWINGS

Figure 12:
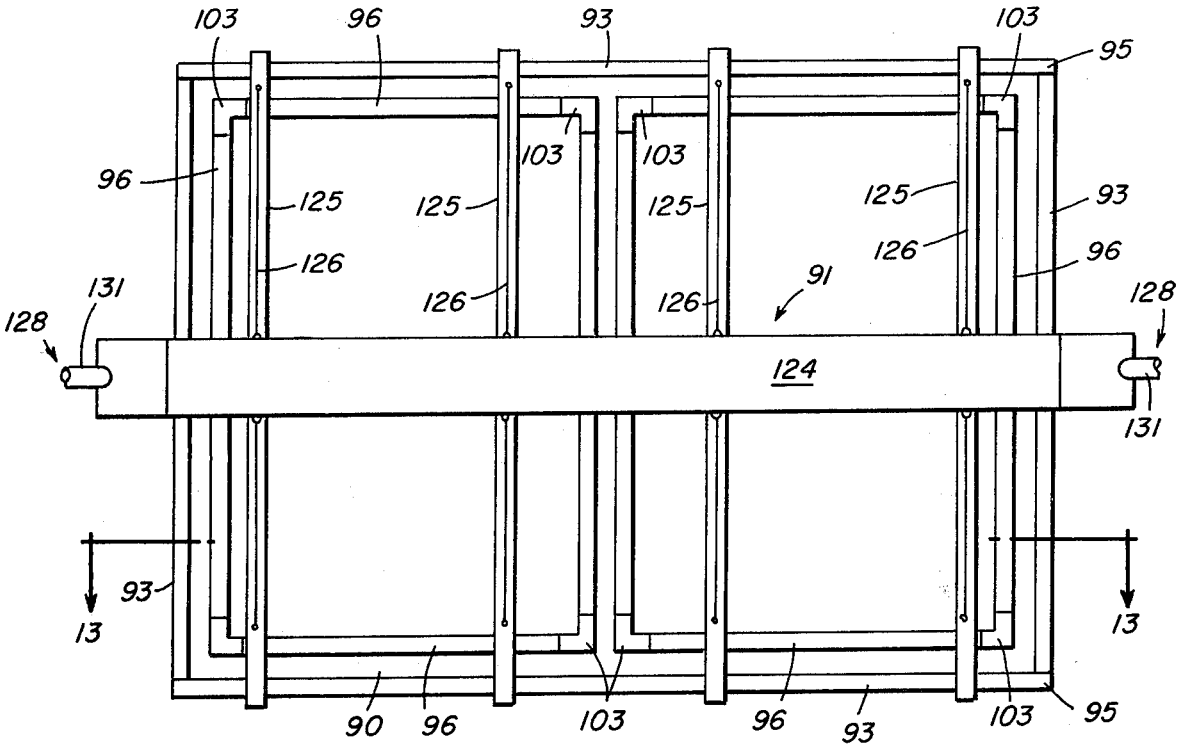
FIG. 12 is a partially schematic plan view of a preferred embodiment of a mold and hoisting frame for use in the inventive system.
Figure 15:
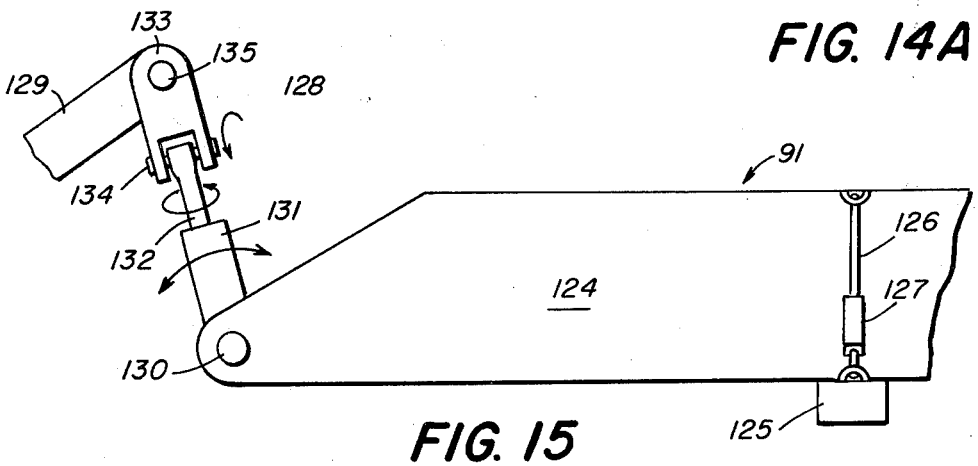
Figure 16A:
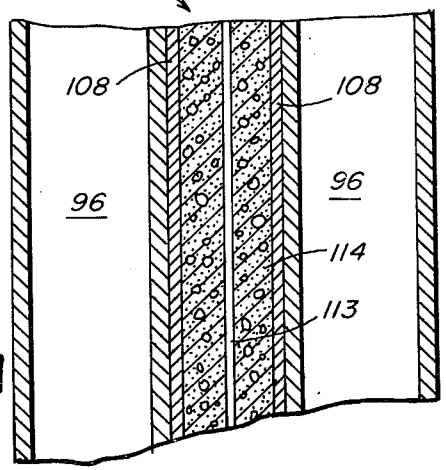
Figure 16:
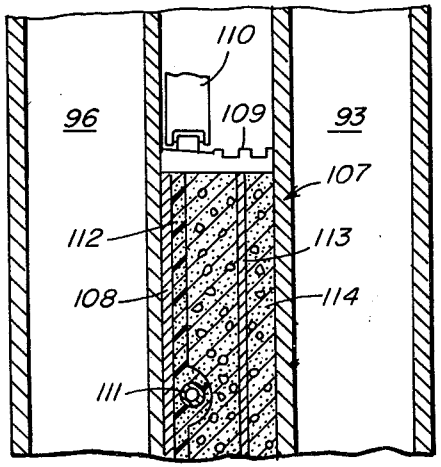
Figure 17:
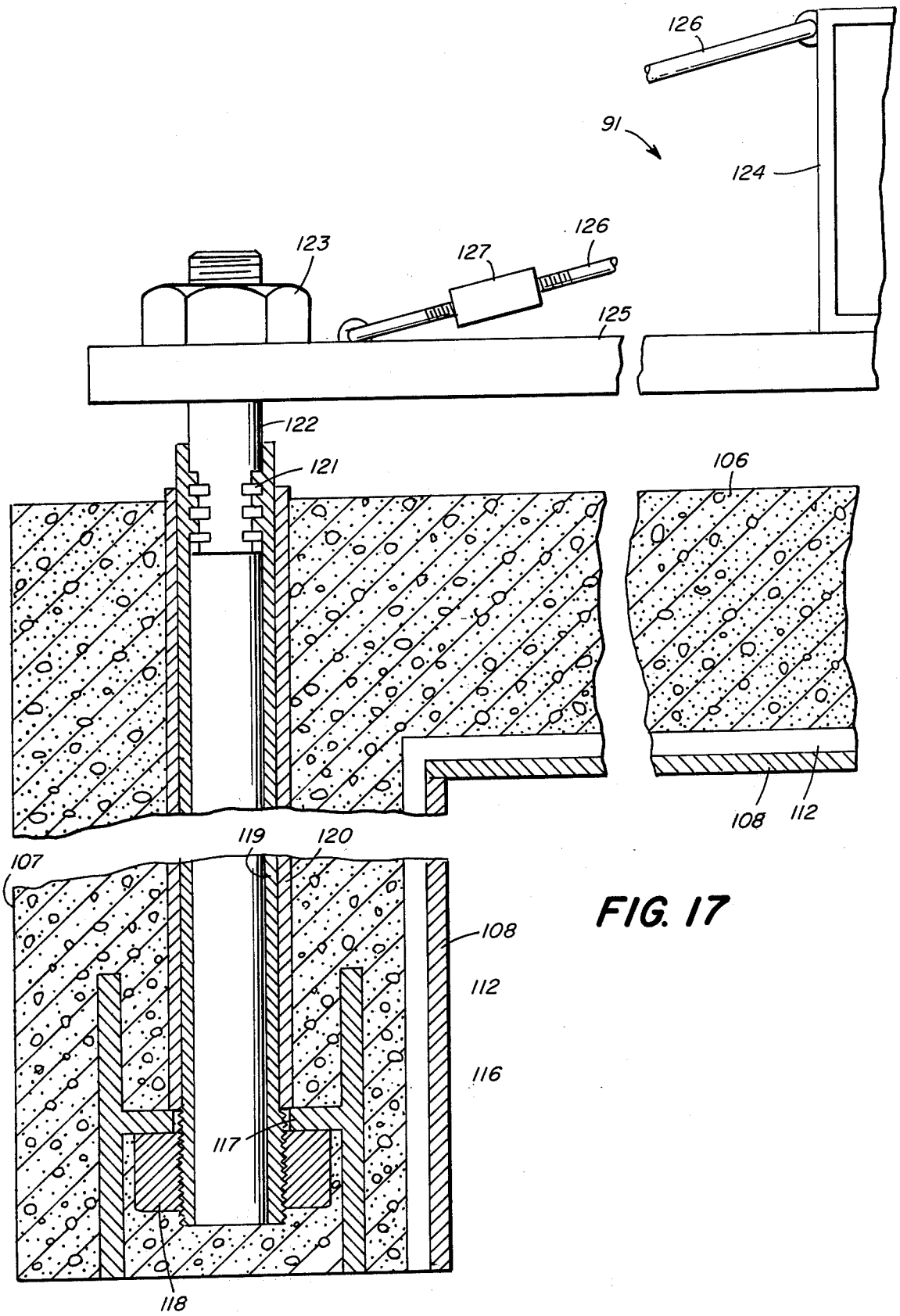

FIG. **14*a* is a perspective, fragmentary view of interior walls and a corner piece from the mold of FIG. 12**;

FIG. 15 is a partially schematic, fragmentary view of one of the ends of the lifting frame of FIG. 12;

FIGS. 16 and **16*a* are partially schematic, cross-sectional views of preferred wall constructions for a casting made in the inventive system; and FIG. 17 is a partially schematic, fragmentary, cross-sectional view of casting anchorages and connecting means for attaching the casting to the lifting frame of FIG. 12**.

BACKGROUND OF THE INVENTION

In the construction industry, there is a continuing need for simplification of construction processes and methods, and for reduction of construction costs. This need is particularly compelling in several areas where large amounts of public funding will be required for construction which may be repetitive in nature. For example, in low cost housing, there is tremendous need for cost reduction, and it is acceptable to achieve this cost reduction partly through repetitive construction of like multi-cell units. Similarly, in many areas of public construction, such as school buildings and the like, there is inherent need for repetitive construction to produce a number of essentially identical schoolrooms.

The needs, of course, are not limited to public construction, but are equally pertinent for a number of private construction operations. For example, in a number of multi-family construction projects, there is a great deal of repetitive construction in which like multi-cell structural units of size comparable with multi-cell structures are repeated. Usually this will be done a number of times in a single location, but it may frequently be desirable in multiple locations. In all forms of construction, both public and private, but it is perhaps more commonly encountered in private construction, the like structural units are arranged in different order to produce a substantially different effect and appearance, but the basic structural units can desirably be repeated again and again to yield the desired number of structural units. This situation holds true for a great diversity of structures, including hospitals and nursing homes, where many of the rooms are repetitive, office and professional buildings, schools, and many others.

These needs have been recognized for many years, and much progress has been made toward meeting the needs. The entire industry of prefabricated housing is based on the understanding of consistent reproduction of like structures and units, and a great deal of prefabricated housing includes conventional construction materials such as wood and the like in preformed sizes and shapes, and also includes less conventional construction materials such as metals also in preformed structures and components. There has been also, in recent years, considerable development of molded preformed structures such as cast concrete and the like which can be preformed at a central location, and then placed at the construction site in such positions as will create a desirable and interesting structural arrangement. For example, in Expo '67, the Canadian Fair in Montreal, there was a significant exhibit called "Habitat", illustrating such prefabricated casting.

Although there has been much progress in advancing new techniques to meet the demands of the construction industry, it is apparent that there still remains much need for continued improvement.

DETAILED DESCRIPTION OF THE INVENTION

Among other things, the most usual prior methods of producing repetitive structures include the production of the basic structure at a remote location and its physical transportation to the construction site as a preformed unit. To the contrary, the present invention contemplates in situ construction whereby repetitive construction units, such as multi-cell units and units of a size comparable with multi-cell units, are formed at the construction site by economical means to produce a completed building, desirably employing local labor, and substantially reducing construction costs.

In accomplishing the desired result, a suitable construction form or mold is produced and is used in situ for repetitive construction of a number of buildings. If desired, the form may be built on location, and used for the repetitive production of a number of like structures appropriately positioned in a construction pattern at the construction site. Alternatively, the construction form or mold may be produced at a remote location and employed in situ to build a number of construction units. A plurality of like units may be produced at a single construction site, or a number of the like units may be produced at various construction sites by transporting the relatively portable construction form rather than transporting the considerably more cumbersome structure itself.

In one embodiment the present invention, accordingly, contemplates an improved method of in situ construction for single or multi-cell structures, including roof, exterior and interior walls, and if desired, includes mechanical elements such as electrical wiring, heating, reinforcing members, windows, insulation, doors and the like. A construction form is prepared and transported to the building location which preferably has a foundation and a slab erected prior to the construction operation. The construction form is correctly positioned at the building location. The mechanical members are properly positioned within the form, and a suitable structural material in flowable form is introduced into the mold. After the structural material has hardened, it is lifted out of the mold, and the mold is mechanically removed from underneath the molded unit. The casting is then lowered onto the building location to produce a substantially finished building, including roof, walls, electrical members, insulation, windows, doors, etc. in an integral unit of great strength to resist hurricanes, tornados, earthquakes and the like.

In the preferred form of the invention a strong-back or lifting frame is used to connect the casting, via anchorages or the like, to lifting means to lift the casting from the mold. The anchorages are secured to this lifting frame and if necessary adjusted so that the lifting forces are uniform along the various points where lifting force is applied. The lifting frame may be hoisted above the mold, and the mold removed, after which the frame and casting are lowered to rest the casting on the ground or on a prepared site. In the presently preferred form of the invention, movable lifting means such as a crane or other lifters connected to the strong-back transport the casting to a prepared on-site construction slab.

The flowable structure material may be any material which is capable of being introduced into a mold and hardened therein, and includes such materials as concrete, plastic and the like. Because of the long experience of the construction industry in dealing with concrete, and because of concrete's structural strength and low cost, it has been found that concrete is a particularly desirable material for the production of extremely sturdy and durable low cost building units. At the same time, it is recognized that certain other desirable results may be achieved through the use of other moldable materials either partially or completely forming the building structure.

Figure 1:
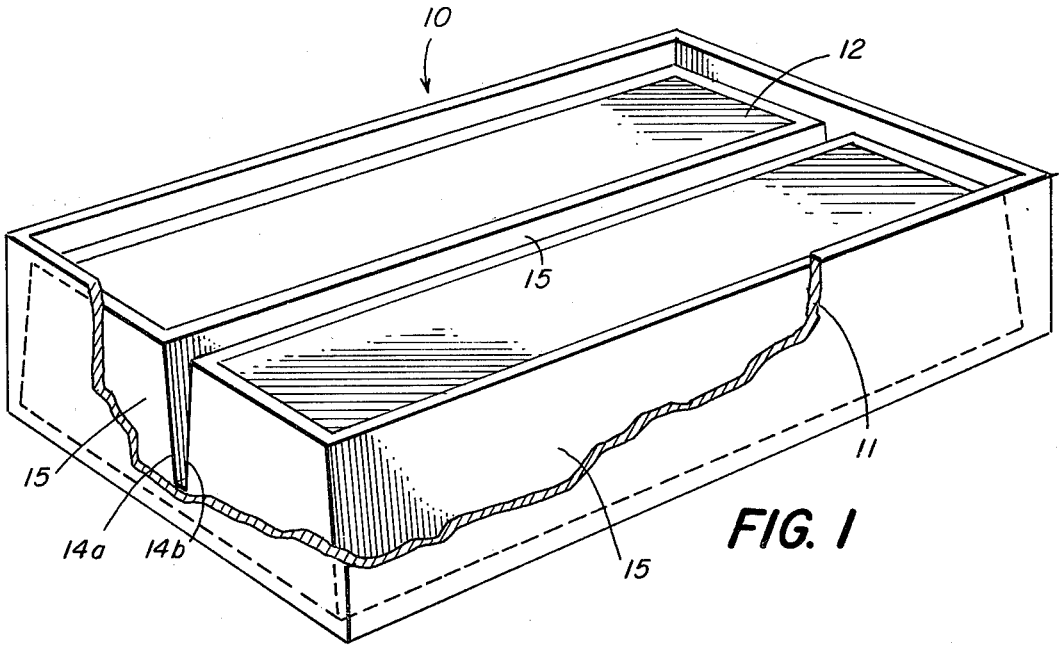
FIG. 1 is a perspective view, partially broken away, of a mold according to one embodiment of the invention.

In FIG. 1 is illustrated partially in section one embodiment of a shell or mold generally designated 10, comprising outside walls 11 and inside top form sections 12, and side walls or side form sections 15 corresponding to the form for the structure to be built. In the embodiment here illustrated, there are two form sections, thus representing a mold for the construction of a two-cell structure such as a two room house. There is a slight taper (exaggerated in the illustration) shown at 14*a*, 14*b* between all form sections 15, permitting a casting to be removed easily from the mold. A taper of a few inches in an eight or ten foot height is adequate.

Figure 2:
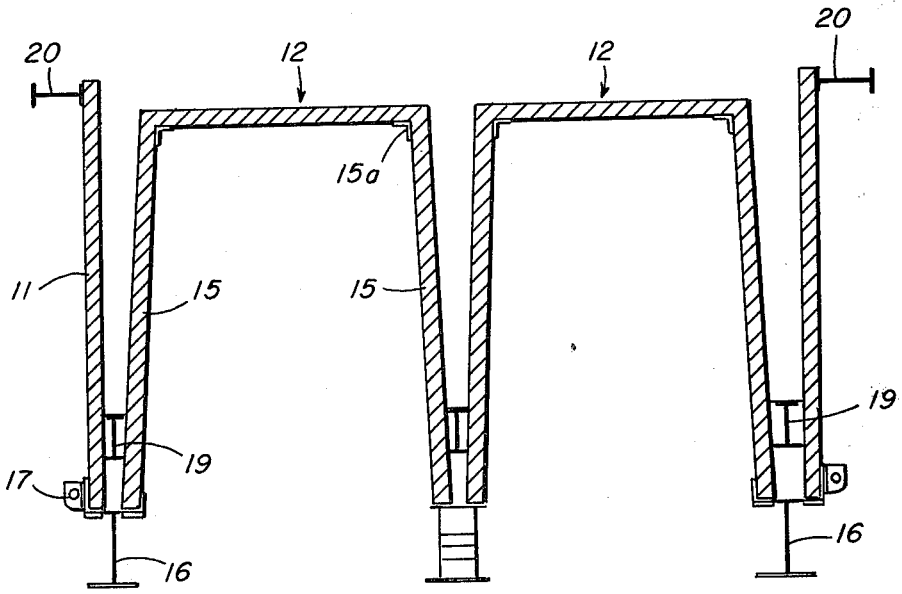
FIG. 2 is an end view in section of the mold of FIG. 1, showing additional elements not included in FIG. 1.

In FIG. 2 is illustrated in section the mold of FIG. 1, with certain detail not shown in FIG. 1, showing the outside walls 11, top form sections 12, and tapered walls 15 of said form sections. Seen in this Figure are optional corner braces strengthening the mold. At the base of the mold 10 is a frame 16 on which the mold stands in use and operation. Frame members 16 may receive wheels or like members to make the mold mobile. Hinge-pin 17 allows outside form 11 to rotate outward, separating the form from the casting so that outside walls are not tapered. Hydraulic jacks 19 shown diagrammatically at the bottoms of the mold cavities are provided to loosen the casting from the mold as will be hereinafter described. At the top and outside of the mold are frame members (not shown) to hold outside walls 11 to inside members 12 and 15 with occasional through bolts. Optional supports 20 are positioned as rests for form sections 11 when rotated out.

Figure 3:
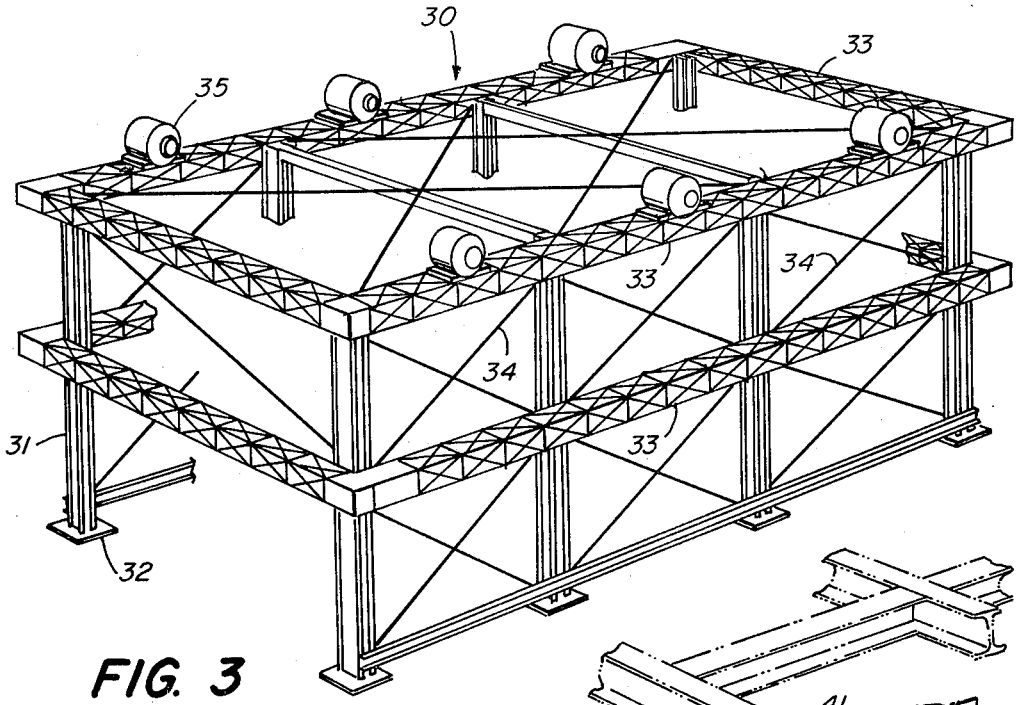
FIG. 3 is a perspective view, partially broken away, of a lifting frame according to the invention.

In FIG. 3 is illustrated a lifting frame 30 which, according to a presently preferred embodiment of the invention, is capable of raising, supporting and lowering loads of 300 tons or more. As will be described hereinafter, this frame can support a multi-cell casting of an entire one floor house. The lifting frame includes a plurality of vertical posts 31 resting on feet 32 and interconnected and supported by horizontal bracing beams 33. At least one set of bracing beams 33 is positioned at or near the top of the posts 31 and one set mid-way to form the major load bearing members of the lifting frame. All these members, comprising the main load bearing components of the lifting frame, are heavy steel structural material such as I-beams or the like (FIG. 5), with internal supports and similar stress structures as necessary. Supporting "X" bracing 34 or the like are provided to add strength and rigidity.

Lifting means such as a plurality of electric motors 35 may operate pulleys with cables (not shown) secured to strong back 40 (see FIG. 4) to raise the strong back, or alternate lifting means, such as for example a crane, may be used for lifting.

Figure 4:
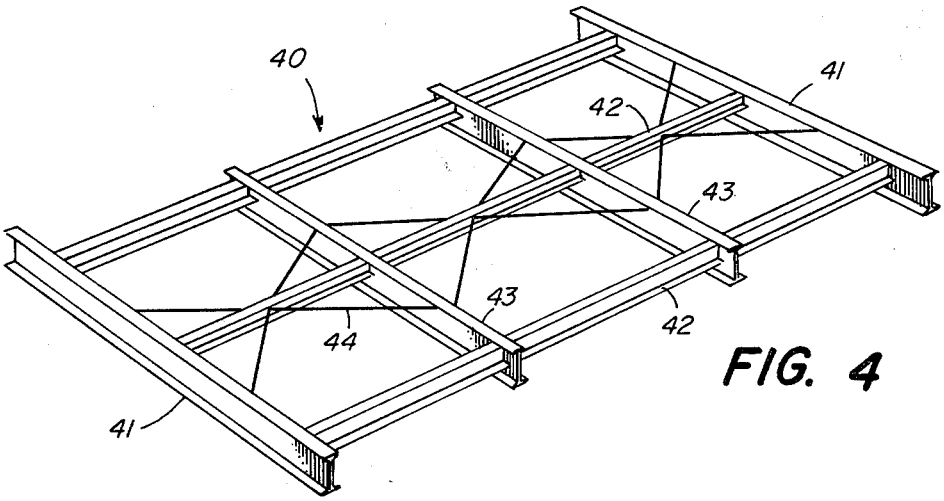
FIG. 4 is a perspective view of a hoisting frame or strong-back.

In FIG. 4 is shown a hoisting frame or strong back 40 comprising end beams 41, longitudinal support beams 42 and cross beams 43 of structural steel such as I-beams secured together and supported by "X" bracing 44 or the like. This hoisting frame is adapted to be mounted in a manner to be vertically movable within the lifting frame 30 so as to be raised and lowered thereon as a unit. This frame is designed to be rigid and strong enough to be the structure that carries the casting so to relieve the casting of any stress in lifting other than its normal design loads.

Figure 5:
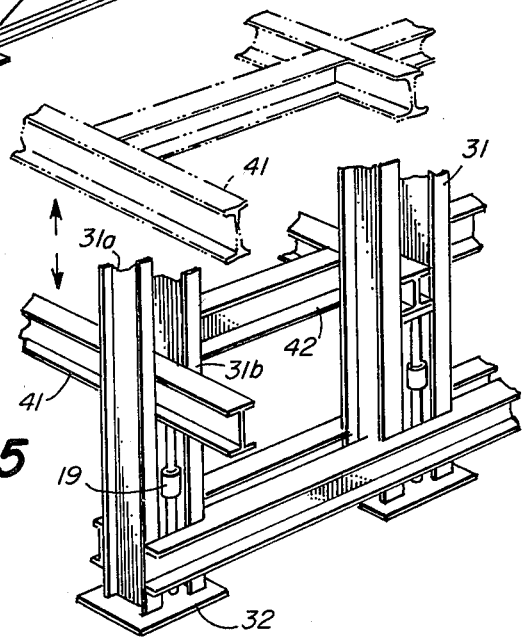
FIG. 5 is a fragmentary enlarged view of the hoisting frame.

As shown in FIG. 5 the hoisting frame 40 may be mounted with its end beam 41 and cross beam 43 interleaved into the vertical posts of the main lifting frame. For example, each vertical post 31 may be two parallel members 31*a* and 31*b* with a slot between to allow end beams 41 and 43 to travel in an up and down direction. As shown in this Figure, jacks 19 may bear on hoisting frame 40 as alternative to bearing directly on the casting as shown in FIG. 2.

Figure 6:
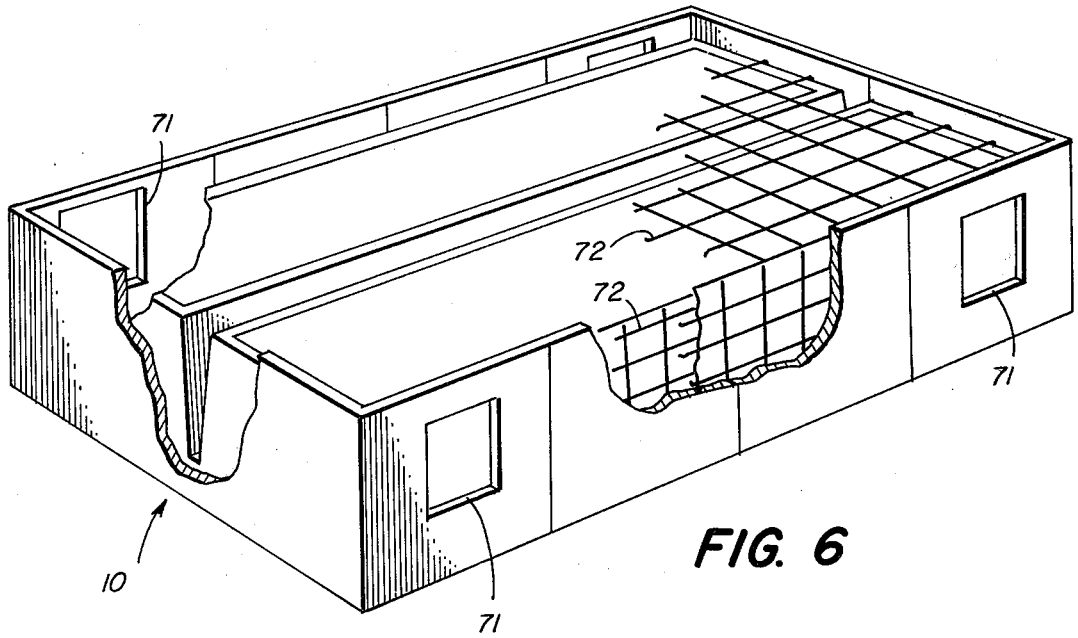
FIG. 6 is a perspective view, partially broken away, of a mold in an intermediate stage of construction.

The operation of the mechanisms according to this embodiment of the invention are illustrated in FIGS. 6, 7, 8 and 9. First the building site is prepared by the construction of suitable foundations such as basements, slabs, or the like. The mold 10 is then moved into the site location, for example, by being dragged in on wheels 13 by a tractor or the like. The mold is placed as close as possible to the desired building location on the foundation or slab, and the mold is lifted off its wheels and blocked. The mold is then prepared as illustrated in FIG. 6 for the pouring of concrete or similar construction material. Windows 71, doors and the like also may be inserted, and mechanical elements of the structure are placed in their proper position in the mold, working from the top. For example, reinforcing members 72 may be placed within the mold in the usual manner to be embedded in and to strengthen the concrete, and insulation 73 (not shown) may be placed in or sprayed in the mold. Similarly, electrical wiring may be placed in the mold at this time if desired, plumbing, heating pipes or ducts and many other articles conventionally employed in building structures, may be inserted at this time before the concrete is added.

When the mold has thus been prepared for pouring, the construction material is then poured into the mold. This construction material may, of course, be conventional concrete or the like. It also may be specially treated and specially prepared concrete products such as quick-drying concrete, aerated concrete, or concrete mixed with decorative material. It also may be, if desired, a plastic material or a fiberglass reinforced plastic material, or in essence, any other flowable, hardenable construction material. This material is poured into the mold and allowed to harden a suitable length of time until it is structurally strong and firm to undergo removal from the mold as illustrated in FIGS. 8 and 9, and as described hereinafter.

Figure 7:
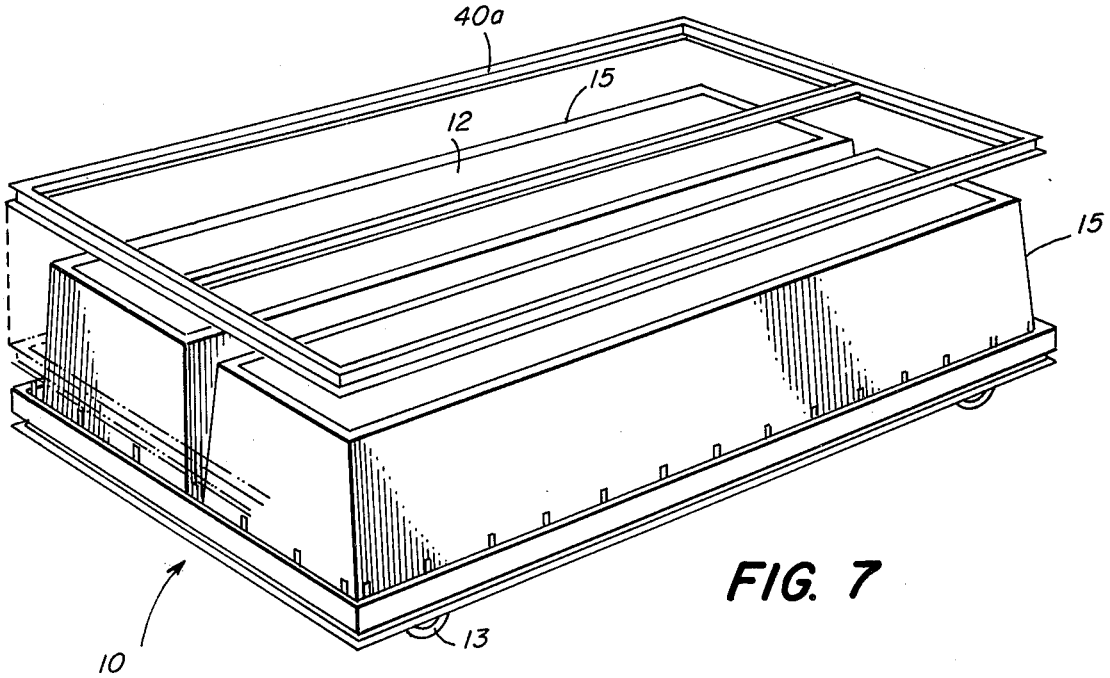
FIG. 7 is a perspective view of a mold and casting illustrating the casting partly removed from the mold.

In FIG. 7 is shown the mold 10 with a casting 81 partially removed therefrom. At this point in the operation, the casting 81 has been raised from the mold by means of jacks 19, and a modified travelling hoisting frame 40*a* has been raised a few inches (shown diagrammatically in the drawing). The wheels 13 are seen in position for moving the mold away from the site.

Figure 8:
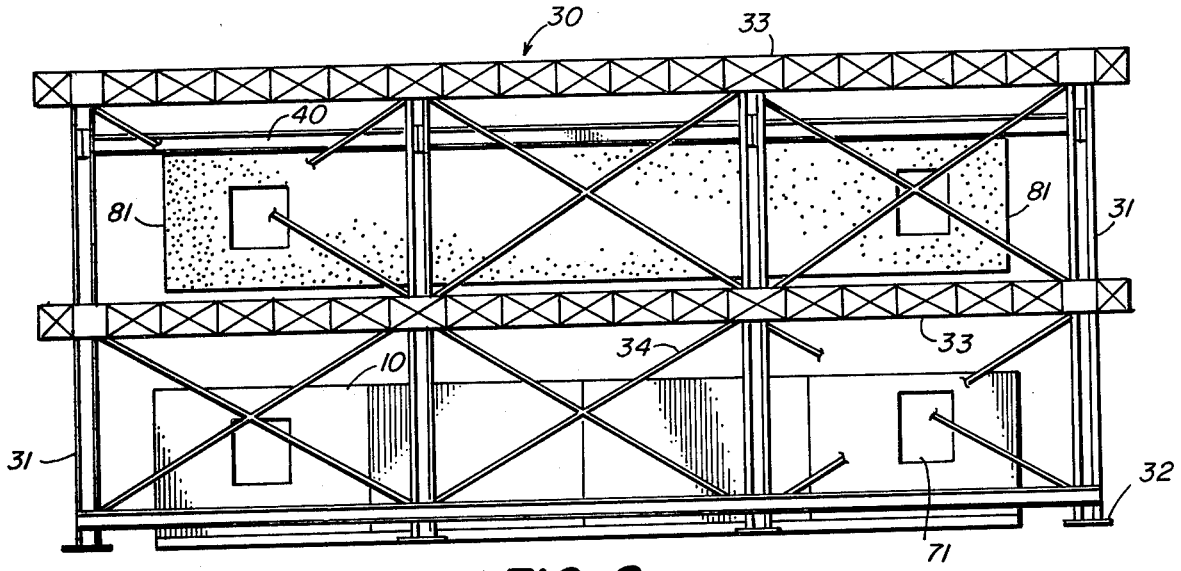
FIG. 8 is a front view of a mold, lifting frame, and hoisted building structure according to one form of the invention.
Figure 9:
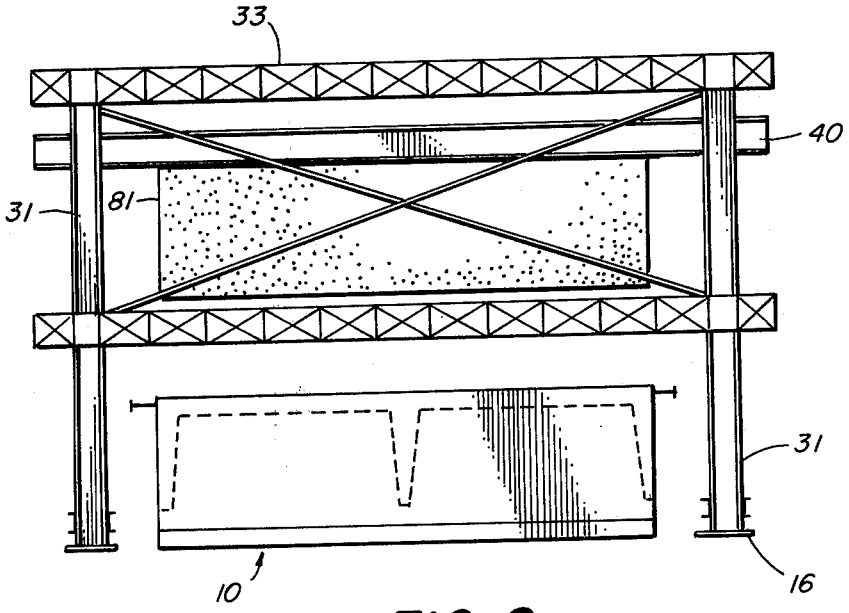
FIG. 9 is an end view of the assembly in FIG. 8.

In FIG. 8 is illustrated the mold 10, positioned on the slab or other building location, the structure 81 such as a multi-room house or the like, suspended above the mold on lifting frame 30. The operations by which this can be achieved are as follows. After the concrete or other material has been poured into the mold and hardened, the lifting frame 30 is hauled in on wheels, and the wheels are removed to cause it to be set firmly and strongly on the ground. The lifting frame 30 is secured to the hoisting frame 40 at a number of locations by steel lifting rods (not shown in this Figure) that are fastened to the hanger beam by bolt and attached to the steel plate and nut embedded in the casting at the bottom of the legs. This rod is located in a conduit, separating it from the casting so that it may be removed from the casting and used again. The details of these connecting rods, anchorages, etc., for connecting the casting to the lifting frame are described in more detail below.

The house or other structure is then loosened from the mold by forcing upward with jacks 19 (see FIG. 2) while vibration optionally has been employed to loosen the concrete from the sides of the mold. This vibration may be employed by mechanical vibration. Once the structure is loose from the mold, it is then raised by the lifting frame. The entire structure is lifted out of the mold gradually, but relatively quickly, until it is suspended in position illustrated by FIGS. 8 and 9, thereupon inboard jacks (not shown) lower the mold to rest on its wheels and the mold 10 is hauled out from under the suspended structure. The structure is then lowered onto the building location. This can be done gradually and quickly as there are no significant difficulties in this operation. During the last few inches of lowering, the structure is carefully guided into the exact position which is desired. The lifting frame 30 then is disconnected from the structure and hauled away by tractor.

Figure 10:
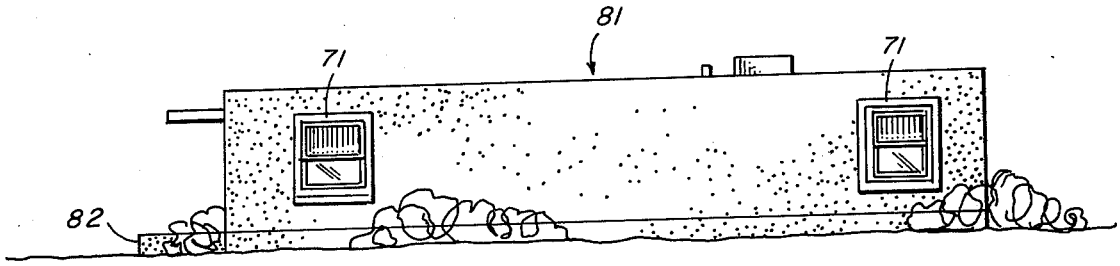
FIG. 10 is a side view of a structure prepared according to this invention.

In FIG. 10 is illustrated a single structure so produced comprising a poured building structure 81 on a slab 82 having windows 71 and other architectural members as desired. The grounds may be landscaped to include shrubs 82 or the like.

Figure 11:
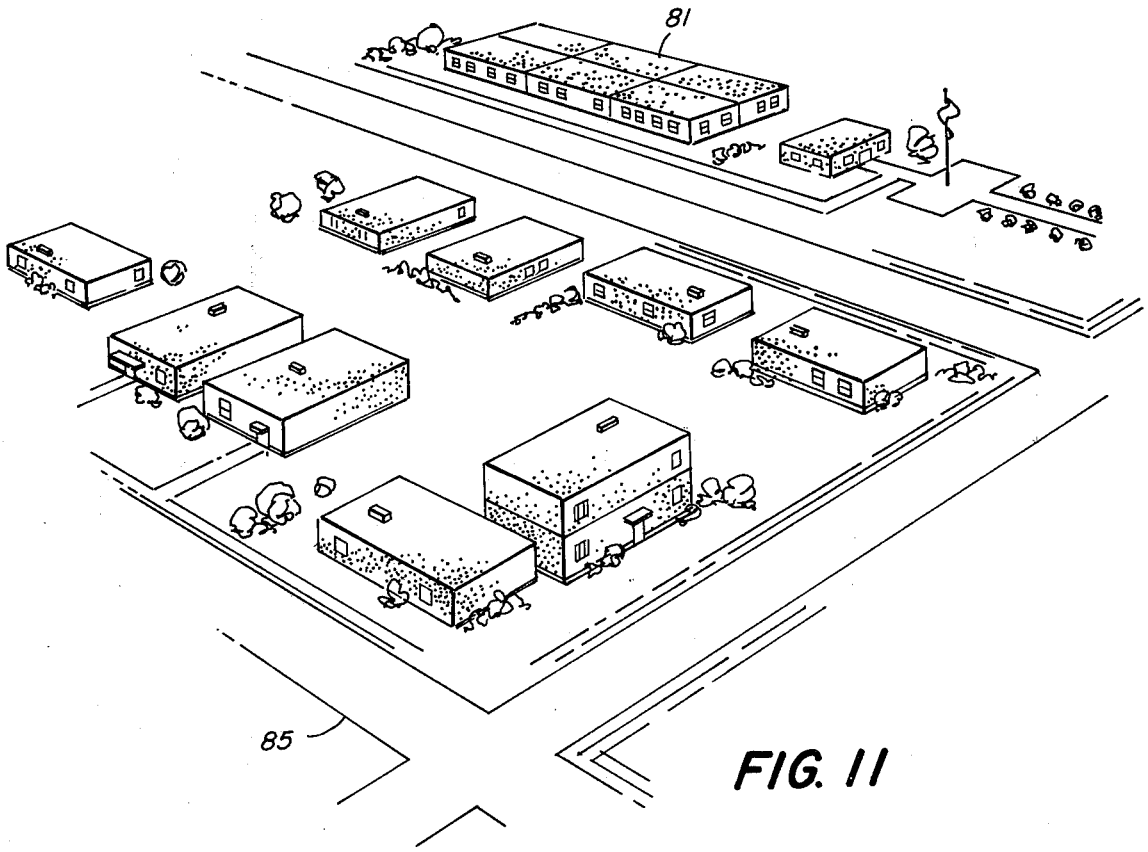
FIG. 11 is a schematic view of a building area according to this invention.

In FIG. 11 is illustrated a building area containing a plurality of structures 81 in an area of land with lots 85 and other improvements as desired. With intelligent architectural design, multi-purpose buildings can be prepared, and each of the structures 81 in FIG. 11 has been produced from the same mold. Different window arrangements have been made differently in the mold prior to pouring the concrete, and individual architectural arrangements have been made. If desired, complete kitchen or bathroom units are available on the market, and can be inserted intact into the structure.

One building 86 in the site is illustrated as a two-level buildings, and if desired any or all of the structures 81 may be employed as the construction site for a second or higher level of like construction. In this situation, each of the vertical walls is a support wall for the structure above it, and a great deal of height can be achieved in the building. To erect a second or higher structure on top of a lower one, the mold 10 is placed in its proper position and after the concrete or like material has been poured into the mold and hardened, a lifting frame 30 is wheeled over the mold. A lifting frame for a multi-story structure is different from the lifting frame for a single story structure only in that the vertical posts are sufficiently tall to fit over the entire building structure. Heights up to about 100 feet are easily achieved, and heights above about 100 feet are feasible if necessary.

Improvements in the inventive system are shown in FIGS. 12–17 and described below. These improvements fall within the general spirit of the inventive system and relate directly to much of what was previously described, and the improvements increase the efficiency, reliability, and versatility of the system. Only the differences in the methods and structures involved in the improvements will be described, on the understanding that they generally follow the basic method described above.

FIG. 12 is a partially schematic plan view of a preferred embodiment of a mold and lifting frame for constructing buildings by the inventive system. Lifting frame 91 is shown arranged over mold 90 for lifting a casting. The preferred ways of operating mold 90, forming a casting, and lifting the casting with frame 91 are described in more detail below.

Figure 13:
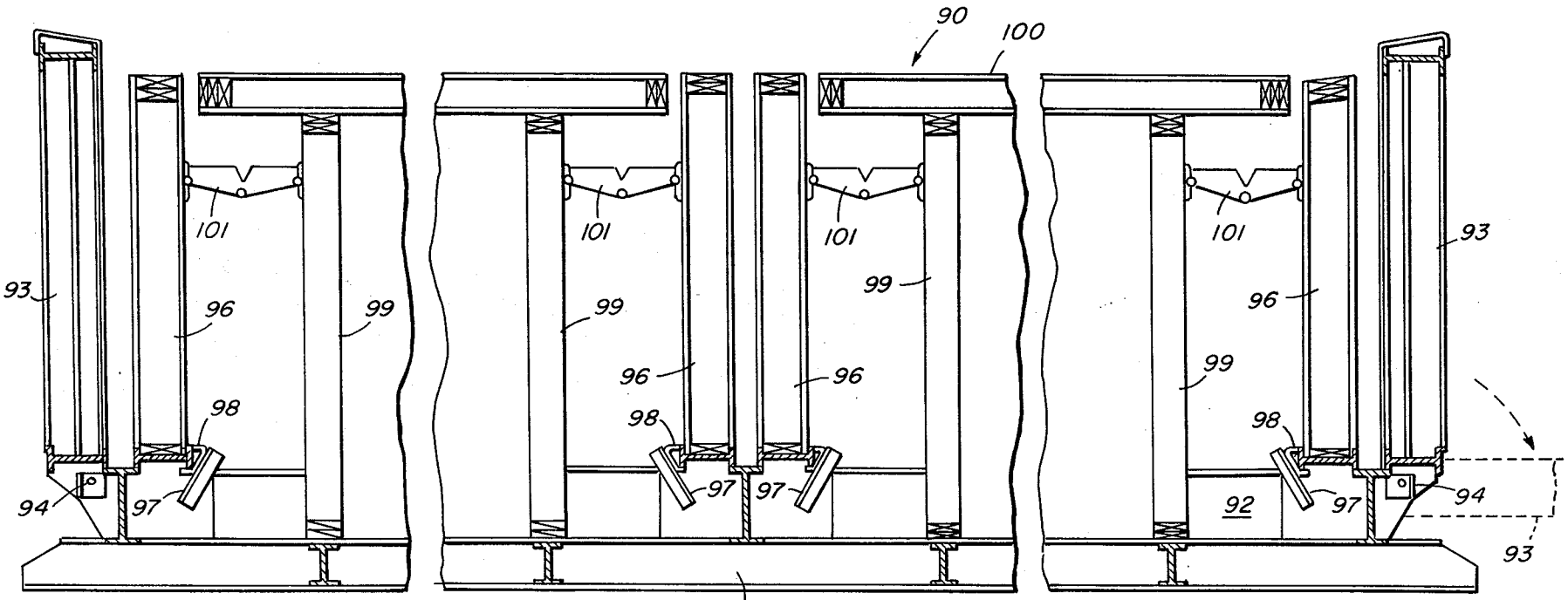
FIG. 13 is a partial cross-section of the mold of FIG. 12 taken along the line 13—13 thereof.

As best shown in FIG. 13, mold 90 has a base 92 supporting interior and exterior mold parts. Exterior walls 93 are connected to base 92 by hinge pins 94 so that walls 93 are pivotal from the upright position illustrated down to a horizontal position for clearing a work region around the inner portion of mold 90. The raising and lowering of external walls 93 is preferably powered as by a hydraulic system (not shown). Walls 93 can be braced or locked in the upright position illustrated in several ways, and one preferred expedient as shown in FIG. 12 is drift pins 95 dropped through holes in overlapping plates of adjacent exterior walls 93.

The internal portion of mold 90 includes outward facing walls or form sections 96 confronting exterior walls or form sections 93. Walls 96 have limited motion and rest on base 92 in a lowermost position as illustrated. The support walls 96 includes a wedge-shaped footing formed by inclined plates 97 on base 92 and angle brackets 98 at the inside of the foot of walls 96. Plates 97 and angle brackets 98 brace the foot region of walls 96. Any such lifting motion of walls 96 allows angle brackets 98 to move inwardly as they rise along inclined plates 97. This allows the foot region of walls 96 to move inward as walls 96 are lifted, and this motion produces clearance between walls 96 and a casting, as the casting is lifted from mold 90.

Inside of walls 96 is an interior structure 99 fixed on base 92 and topped off with a ceiling support frame 100. Walls 96 have a small working clearance around ceiling support frame 100 to allow upward and inward motion of walls 96.

The upper region of walls 96 is supported by toggle levers 101 that are hinged to brace walls 96 rigidly outward in the lowermost position of walls 96 and to allow walls 96 to move inward as they are raised. Toggles 101 thus cooperate with plates 97 and brackets 98 in allowing inward motion of walls 96 as they are raised from the lowermost position. This ensures release of walls 96 from a casting as it is lifted from mold 90.

As can be seen, when walls or inside form sections 96 rest on base 92 they are wedged tight, but as they are raised they are relatively loose making it easy to release a casting 81 which is pulled upwards.

Figure 14:
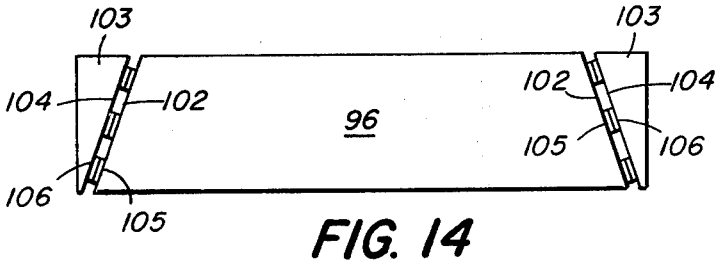
FIG. 14 is a partially schematic, elevational view of an interior wall and corner pieces from the mold of FIG. 12.
Figure 14A:
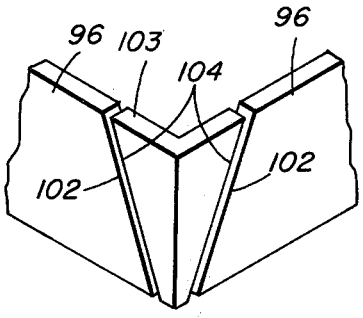

As best shown in FIG. 14, walls 96 are preferably generally trapezoidal in shape with ends 102 that taper downward and outward as illustrated. Corner walls 103 are arranged at the ends of walls 96, and as shown in FIGS. 12 and 14, corner walls 103 have a right angle form for rounding a corner between perpendicular and adjacent walls 96. The mating ends 104 of corner walls 103 have a taper opposite to the taper of ends 102 of walls 96 for fitting against the ends 102 of a pair of perpendicular and adjacent walls 96. The perspective fragment of FIG. 14*a* best shows corner walls 103 as corner-shaped wedge pieces fitting between adjacent and perpendicular walls 96.

Ends 102 and 104 of walls 96 and 103 are respectively provided with bearing plates 105 and 106 positioned for mutual engagement. Bearing plates 105 and 106 allow easy adjustment between walls 96 and 103 by selecting plates 105 and 106 of different thicknesses or different combinations of plates for accurate adjustment of the overall length of a wall formed of wall pieces 96 and 103. Plates 105 and 106 also afford a smooth, friction surface for sliding motion between corner pieces 103 and walls 96, and are preferably lubricated to facilitate this.

The tapered contact between walls 103 and 96 allows corner pieces 103 to move freely when they are loosened as the casting 81 is raised upward, assuring release of corners 103 from a casting as it is lifted from mold 90. The relative movability of walls 96 as previously described thus cooperates with the movability of corner walls 103 relative to walls 96 to ensure internal release inside a casting as the casting is lifted, inasmuch as the walls 96 and corner walls 103 are not wedged tightly when upward force is applied. In effect walls 96 and corner walls 103 fall off the casting.

Walls 96 and corner pieces 103 have been described as outward facing, but actually the same arrangement can be used for interior walls of a casting to be made in mold 90. Each internal corner and internal mold wall is preferably formed of walls 96 and 103 as described above whether the wall in question is an external or internal wall of the building.

The internal mold parts for automatic release from the casting as described above would normally be rejected as unworkable because they include small openings and working clearances that would be penetrated by concrete. However, the inventive system includes a novel construction that not only overcomes this problem, but has many advantages in simplicity and economy in forming buildings. This construction is best illustrated by the fragments of wall sections shown in FIGS. 16 and 16*a*.

Wall fragment 107 is formed between exterior mold part 93 and interior mold part 96 and includes a wallboard 108 arranged against interior mold wall 96 to provide a finished interior surface and to bridge small gaps and clearances in the internal part of mold 90. Wallboard 108 also acts as a release element for easy release between mold walls 96 and casting 81. Window or door frame 109 is first arranged against internal mold wall 96 and supported in position by expandible brackets 110, then wallboard 108 is arranged against internal mold wall 96 around window and door frames 109. Electric conduit 111 and any other desired wall fixture is arranged outside wallboard 108, then a foamed resin material 112 such as foamed polyurethane is sprayed over wallboard 108 and conduits 111 outside of window and door frames 109 for sealing cracks and joints and providing building insulation. The resin material also acts as a glue to hold the various elements in place until the casting material is placed in the mold. Many foamed resin materials are suitable for this so long as they form a firm bond to wallboard 108, provide the desired sealing and insulation, and are rigid enough not to collapse when the mold is filled with concrete.

Then concrete reinforcing material 113 (see also reinforcing 72 in FIG. 6) is arranged outside of foamed resin 112, and mold 90 is filled with concrete or other hardenable material 114 to complete wall 107. Concrete 114 forms a secure bond with foamed resin material 112 and extends out to the exterior of wall 107 adjacent exterior mold wall 93. The result is a finished wall 107 having the desired door and window frames 109, and including an interior wallboard finish 108, insulation 112, and conduit or other fixtures 111. This is far more expeditious than forming a concrete-tight mold, casting a solid concrete wall, and then manually installing insulation and interior finish to the casting.

A similar wall 115 is illustrated in FIG. 16*a* as formed between opposed internal walls 96 to form an interior wall for the building. Wall 115 has preferably continuous wallboard 108 arranged on each surface adjacent mold walls 96, but foamed insulation material is omitted, and after reinforcing material 113 is positioned, the space between wallboards 108 is filled with concrete 114. Door openings are blocked out between wallboards 108 which are later cut away at the door openings.

Ceiling or roof portions 106 of the building formed over ceiling support frames 100 are preferably similar to walls 107 except for the lack of window or door frames 109. Then both the ceiling and walls all over the interior of the casting have finished wallboard surfaces 108, include the necessary insulation, and are joined in one continuous, integral casting. Such a casting has the desired fixtures and is nearly completed as a building structurally reinforced and ready for lifting as a unit. Furthermore, the lifting includes relatively simple and convenient automatic release from the internal parts of a mold.

The building formed in mold 90 is also provided with anchorages for connections to lifting frame 91 for raising and transporting the casting. These are best shown in FIG. 17.

Anchorages preferably formed of I-beam blocks 116 are placed at selected points around base 92 at the bottom region of exterior and interior walls of the building to support connecting rods that are coupled to lifting frame 91. I-beam blocks 116 have bore holes 117 and nuts 118 welded to the underside of blocks 116 in registry with bore holes 117. A threaded rod or pipe 119 is inserted through hole 117 and screwed into nut 118 as illustrated, and pipe 119 extends upward through wall 107 to the top of the building. A sleeve 120 preferably formed of cardboard or other inexpensive material surrounds pipe 119 to keep the concrete in wall 107 from bonding directly to pipe 119.

A bayonet joint 121 is formed in the upper interior of pipe 119, and a coupling piece 122 is removably mated in joint 121 to extend above pipe 119. Coupling piece 122 is threaded so that a nut 123 turned onto coupling piece 122 adjustably secures lifting frame 91 to anchorage 116.

Lifting frame 91 includes a box beam 124 extending along the longitudinal back of frame 91 and cross members 125 that extend to the perimeter of the building. Tension rods 126 extend from the top of box beam 124 to the outer regions of cross members 125, and are preferably adjustable by turnbuckles 127 to support cross members 125. Nuts 123 are also adjustable on threaded coupling pieces 122, preferably by marking the desired thread position for nuts 123 and by torque on nuts 123, for adjusting the tension applied to each of the connecting pipes 119. Anchorages 116 are preferably positioned fairly evenly relative to the weight of the building, and tension adjustments made in nuts 123 and turnbuckles 127 are set so that lifting frame 91 exerts tension on the anchorages 116 for proportionally distributing the weight of the building over the anchorages and coupling hardware. This assures even distribution of stress over the building and prevents cracking, breaking, or other damage in lifting and transporting the building.

Frame 91 is preferably arranged over mold 90 and coupled to the cast building after the mold has been filled. When the casting has set, frame 91 is lifted to release the casting from mold 90, raise the casting up out of mold 90 and transport it to a nearby building site. After the building is set in place, frame 91 is disconnected by loosening nuts 123 and removing coupling pieces 122. Frame 91 is then returned to the mold and connected to the next building to repeat the process. Connecting pipes 119 are preferably removed from the finished building by unscrewing them from anchorages 116 and nuts 118 so they can be reused for the next building. The opening left after removal of pipes 119 is then plugged and sealed.

The lifting of frame 91 for raising and moving the building is preferably accomplished through universal joint couplings 128 arranged at the ends of frame 91 as best shown in FIG. 15. Each of the couplings 128 is preferably engaged by the boom 129 of a wheeled lifting vehicle (not shown), such as a log stacker. A pair of such vehicles connected to frame 91 through universal joints 128 can then work as a team in lifting frame 91 and then maneuvering about to transport frame 91 and the supported building between the vehicles in a move to a building site. The universal motion of joint 128 allows all the combinations of vehicle and boom motion to accomplish such lifting and maneuvering.

Universal joints 128 are connected to frame 91 at horizontal pivots 130 that allow vertical pivotal motion of shafts 131. Shafts 131 house coaxial shafts 132 that are pivotal around the axis of shafts 131 and 132, and a clevis 133 is connected to each of the shafts 132 at pivot 134 oriented in one plane and to booms 128 at a pivot 135 oriented in the opposite plane. Couplings 128 thus allow universal motion between booms 129 and frame 91.

The improvements of FIGS. 12–17 carry on the basic premises of the inventive system in providing a simplified method and improved mold with automatic internal release and vertical and square internal surfaces. They also improve the construction of the building in providing finished interior walls, sealing and insulation. Also, the improved lifting frame 91 is simpler, more efficient, and better adapted to raising and transporting building. The same basic concepts of the invention remain, but the improvements enhance the commercial and practical advantages of the inventive system.

Persons wishing to practice the invention should remember that other embodiments and variations can be adapted to particular circumstances. Even though one point of view is necessarily chosen in describing and defining the invention, this should not inhibit broader or related embodiments going beyond the semantic orientation of this application but falling within the spirit of the invention. For example, those skilled in the art will appreciate the different designs and structures available in adapting the inventive system to particular circumstances. Buildings of many shapes and sizes with many different wall arrangements can be made by the inventive system for housing, industrial, office, educational, and other purposes, and those skilled in the art will understand how to meet all these needs by application of the inventive system.

I claim:

1. A building construction system comprising:

(a) a mold to receive hardenable casting material such as concrete or the like, having a base supporting an internal portion and an external portion to receive such casting material to form a building, said external portion including outside mold walls positionable to define outside faces of external building walls and said internal portion including inside form sections;

(b) means connecting said outside mold walls to said base for positioning said outside mold walls adjacent inside form sections to define external building walls, and for moving said outside mold walls into molding configuration toward said internal portion and out of molding configuration away from said inside form sections; and (c) said internal portion comprising:

(1) inside form sections defining at least one mold section for at least one interior building partition, and (2) inside form sections facing said outside mold walls to define exterior building walls, (3) means for supporting said inside form sections on said base for motion relative to said base to release a casting upon lifting from said mold; and (4) said supporting means including means for bracing said walls against inward motion from a lowermost position of said walls and means permitting inward motion of said inside form sections thereby releasing said casting material after hardening thereof as said walls are raised from said lowermost position.

2. The system of claim 1 wherein said inside form sections have wedge-acting support means positioned to hold said inside form sections normally in mold configuration and to release said inside form sections from mold configuration by the action of upward force to said sections.

3. The system of claim 1 wherein inside form sections of said internal portion include generally plane panels and separate corner walls.

4. The system of claim 3, wherein said inside form sections include plane walls which are generally trapezoidal in shape and said corner walls are generally wedge-shaped to fit between the ends of said trapezoidal walls, whereby said corner walls become loosened when upward force is applied thereto.

5. The system of claim 4, wherein the ends of each of said trapezoidal walls and the mating surfaces of said corner walls are provided with adjustable inclined bearing plates.

6. The system of claim 1 including an interior structure mounted on said base inside the inside form sections and having supporting means including toggle levers arranged for bracing said inside form sections, wedge-shaped footing means for supporting said form sections and ceiling support means arranged on said interior structure.

7. The system of claim 1, including preformed release elements which are adapted to be visible elements in a completed structure, said release elements being positioned against said inside form sections to prevent contact in release areas between form sections and hardenable casting material.

8. The system of claim 1 including connecting means positioned in the base region of said mold and extending above said mold and means to fasten said connecting means to external apparatus for lifting a casting out of said mold.

9. The system of claim 7, wherein said connecting means includes a plurality of elements positioned around said mold and located to be embedded in hardenable material in the casting and near the base thereof, whereby said casting is lifted by compression forces acting on the casting.

10. The system of claim 6, wherein said release element is wallboard.

11. The system of claim 1, wherein said outside mold walls and said inside form sections include means defining window and door openings for a building to be cast in said mold.

* * * * *